United States Patent [19]

Kojima et al.

[11] Patent Number: 4,653,464

[45] Date of Patent: Mar. 31, 1987

[54] PORTABLE HEATING UNIT

[75] Inventors: Nobuyuki Kojima; Youichi Sekigawa, Makoto Kobiyama, all of Niigata, Japan

[73] Assignee: Toshiba Heating Appliances Co., Ltd., Niigata, Japan

[21] Appl. No.: 615,584

[22] Filed: May 31, 1984

[51] Int. Cl.[4] ..... F24C 1/14

[52] U.S. Cl. ..... 126/63; 126/92 B; 126/96; 126/202

[58] Field of Search ..... 126/92 B, 93, 95, 96, 126/202, 121, 123, 63; 431/34, 88

[56] References Cited

U.S. PATENT DOCUMENTS

| | | | |
|---|---|---|---|
| 3,952,721 | 4/1976 | Patterson | 126/63 |
| 4,191,162 | 3/1980 | Simms | 126/121 |
| 4,458,664 | 7/1984 | Uchida et al. | 126/96 |
| 4,474,166 | 10/1984 | Shaftner et al. | 126/96 |
| 4,488,536 | 12/1984 | Kojima et al. | 126/96 |

FOREIGN PATENT DOCUMENTS

| | | | |
|---|---|---|---|
| 142131 | 8/1983 | Japan | 126/93 |

*Primary Examiner*—Carroll B. Dority, Jr.
*Attorney, Agent, or Firm*—Rey Eilers

[57] ABSTRACT

A portable heating unit has a heating chamber which is disposed within a housing so substantially all of the exterior thereof is displaced inwardly from that housing to define an air space. Air passing through that air space absorbs heat from the exterior of that heating chamber and also absorbs, and carries away, heat radiated from that exterior. That heating chamber is secured to that housing by mountings of small cross sections, which limit the amount of heat that can be conducted from that heating chamber to that housing. In addition, a baffle is interposed between the heating element and housing of the portable unit to reduce the amount of heat passing to that housing. A flame interceptor on the inner surface of the top of the heating chamber will largely intercept any flame which could develop as the wick of the combustion element was raised; and a guard is provided for the front of the heating chamber to minimize the risk of anyone contacting that heating chamber and also to keep the heating element from contacting the floor in the event the portable heating unit were to be tilted over onto its face.

6 Claims, 21 Drawing Figures

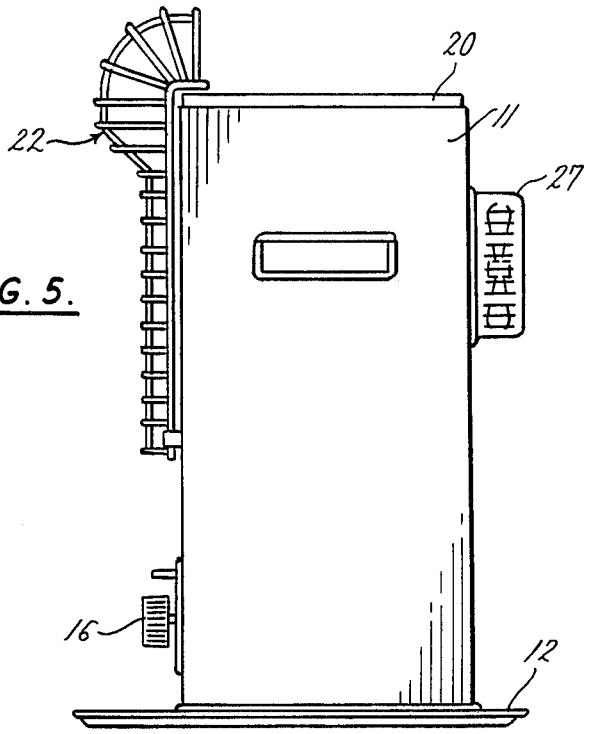
FIG. 5.
FIG. 6.
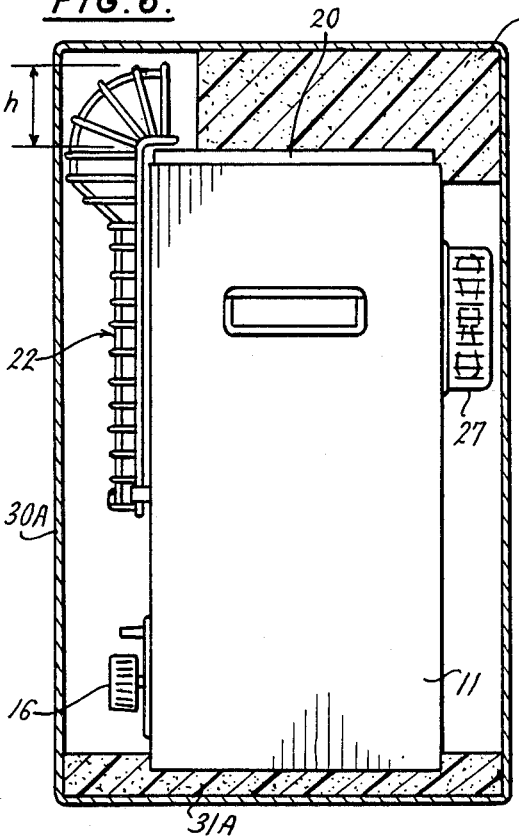
FIG. 7.
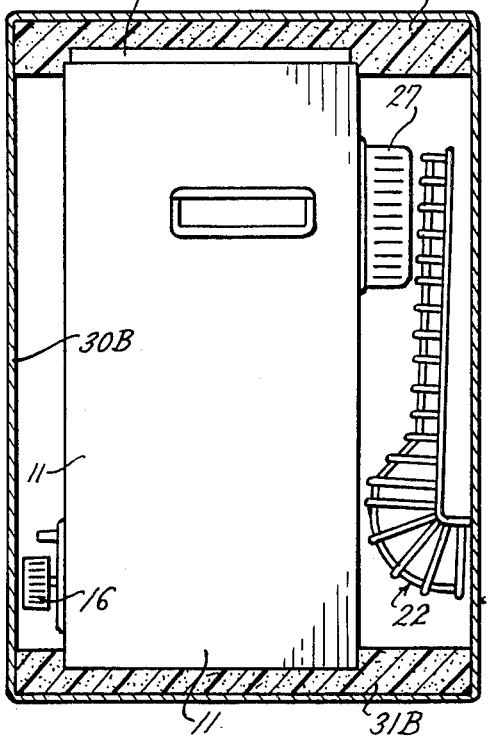

12
12
132
136
138
40
54
90
102
134
92
96
100
104
72
70
88
80
64
93
98
68
66
82
74
65
67
56
44
86
58
50
48
120
112
122
134
88
126
62
60
140
46
110
114
116
42

PORTABLE HEATING UNIT

BRIEF SUMMARY OF THE INVENTION

A portable heating unit has a heating chamber which is disposed within a housing so it has substantially all of the exterior thereof displaced inwardly from the inner surface of that housing to define an air space. Air is permitted to enter, and to move upwardly, through that air space to (a) contact the exterior surface of that heating chamber to limit the temperature rise of that exterior surface and (b) keep relatively-cool air moving through that air space to absorb, and carry away, heat that otherwise would be radiated from that exterior surface to that inner surface. As a result, the amount of heat which is transferred from the heating chamber to the housing, and hence the temperature of that housing, will be limited. It is, therefore, an object of the present invention to provide a portable heating unit with a heating chamber which has substantially all of the exterior thereof displaced inwardly from the inner surface of the housing for that portable heating unit to define an air space through which relatively-cool air can move.

The heating chamber is secured to the housing by mountings which have small cross sections. The amount of heat which can be conducted from the heating chamber to the housing through those small cross section mountings will be limited; and hence the temperature rise of that housing will be limited. It is, therefore, an object of the present invention to provide a heating chamber that is mounted within a housing by mounting means which have small cross sections.

The portable heating unit provided by the present invention has a combustion unit which develops products of combustion that tend to move directly upwardly against the top of the heating chamber. A baffle is disposed intermediate that combustion unit and the top of the heating chamber to receive most of the products of combustion from that combustion unit, and thereby keep many of those products of combustion from directly impinging upon that top. As a result, the heating chamber will not become as hot as it could if the products of combustion were to directly impinge upon the top of that heating chamber. It is, therefore, an object of the present invention to provide a baffle intermediate the top of the heating chamber and the combustion unit disposed within that heating chamber.

The baffle is secured to the heating chamber by mounting means which have small cross sections. The heat which can be conducted from the baffle to the heating chamber will be limited by the small cross sections of those mounting means; and hence the heat which is conducted from the baffle to the heating chamber will not unduly increase the temperature of that heating chamber. It is, therefore, an object of the present invention to dispose a baffle between the top of a heating chamber and the combustion unit within that heating chamber by mounting means which have small cross sections.

A flame interceptor is mounted on the inner surface of the top of the heating chamber. That flame interceptor will intercept any flame which could develop as the wick of the combustion unit was being raised. It is, therefore, an object of the present invention to provide a flame interceptor on the inner surface of the top of the heating chamber of a portable heating unit.

A baffle is mounted intermediate the top of the heating chamber and the top of the housing. That baffle will intercept heat which is radiated by the top of the heating chamber toward the top of the housing; and, as a result, the top of the housing will receive less radiated heat from the top of the heating chamber than it would if heat were permitted to impinge directly upon the top of that housing. It is, therefore, an object of the present invention to dispose a baffle intermedate the top of the heating chamber and the top of the housing for that heating chamber.

A guard is positioned in register with the major portion of the front of the heating chamber; and hence that guard minimizes the likelihood of contact between persons and objects and that heating chamber. In addition, that guard extends upwardly beyond the top of the housing to keep persons and objects from contacting the portions of that housing where the air exits from the air space between the exterior of the heating chamber and the inner surface of that housing. It is, therefore, an object of the present invention to provide a guard which overlies the major portion of the front of the heating chamber of a portable heating unit, and also extends above the level of the top of the housing for that portable heating unit.

The heat-radiating unit of the combustion unit of the portable heating unit is normally fixed in position within the heating chamber of that portable heating unit. However, in the event that portable heating unit were to be tilted forwardly so it came to rest facing the floor, that heat-radiating unit could fall away from its normal position within the heating chamber and then fall toward the floor. The guard provided by the present invention will intercept that heat-radiating unit and hold it a predetermined minimum distance away from the floor, so that heat-radiating unit can not ignite the floor or any covering thereon. It is, therefore, an object of the present invention to provide a guard for a portable heating unit which will intercept the heat-radiating unit of that portable heating unit and will then hold that heat-radiating unit a predetermined minimum distance away from the floor in the event that portable heating unit were to be tilted over to face the floor and that heat-radiating unit were to become dislodged from its normal position within the heating chamber.

Other and further objects and advantages of the present invention should become apparent from an examination of the drawing and accompanying description.

Several preferred embodiments of the present invention are shown in the drawing and accompanying description; but it is to be understood that the drawing and accompanying description are for the purpose of illustration only and do not limit the invention and that the invention will be defined by the appended claims.

BRIEF DESCRIPTION OF DRAWING

In the drawing, FIG. 5 is an elevational view of the right-hand end of a second preferred embodiment of portable heating unit which is made in accordance with the principles and teachings of the present invention, FIG. 6 is a sectional view of a shipping container for the portable heating unit of FIG. 5, FIG. 7 is a cross-sectional view of a different shipping container for the portable heating unit of FIG. 5.

Figure 1:
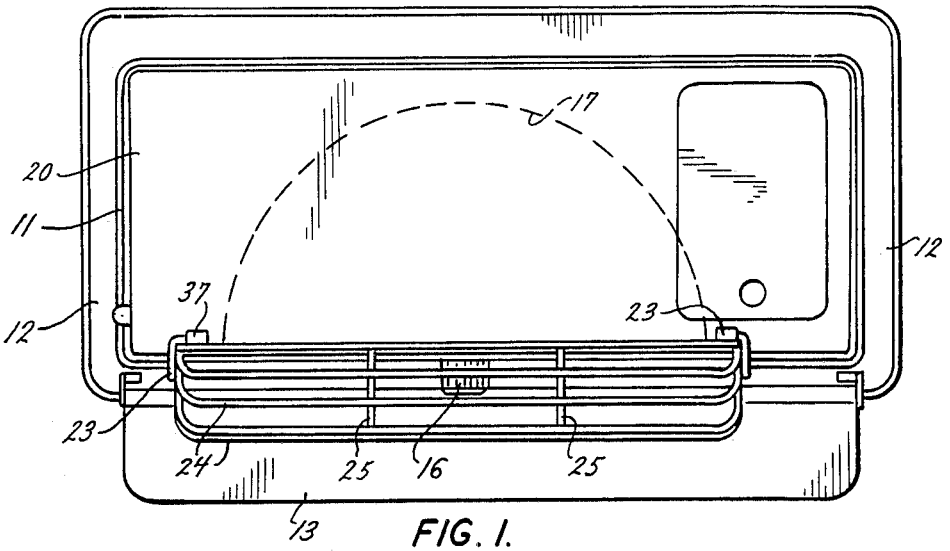
FIG. 1 is a plan view of one preferred embodiment of portable heating unit which is made in accordance with the principles and teachings of the present invention.
Figure 2:
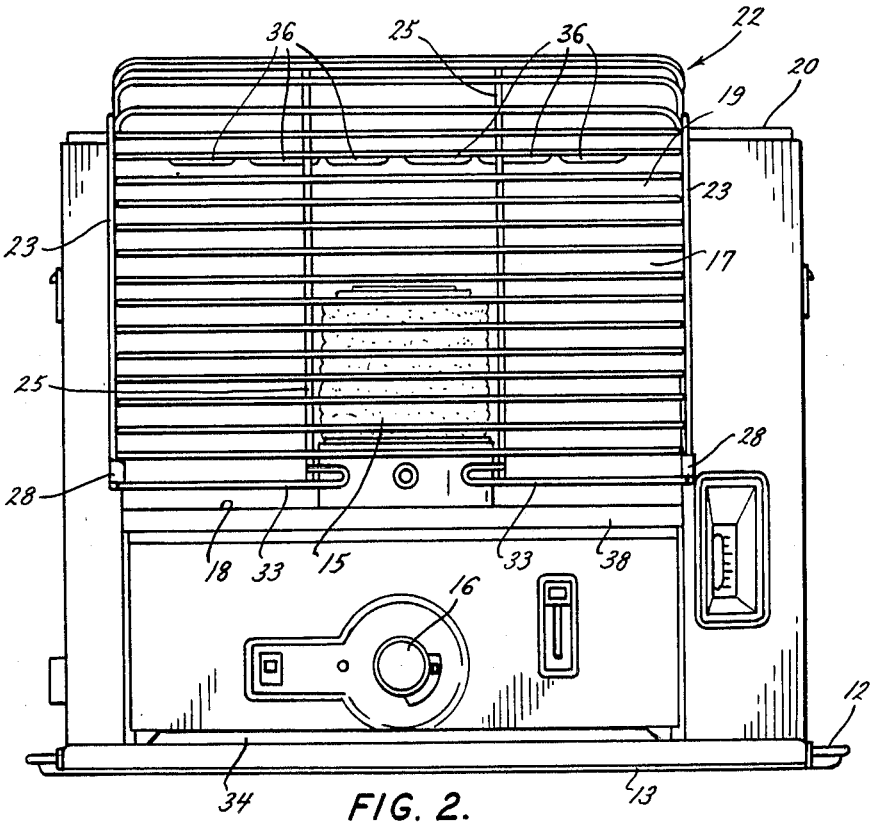
FIG. 2 is a front elevational view of the portable heating unit of FIG. 1.
Figure 3:
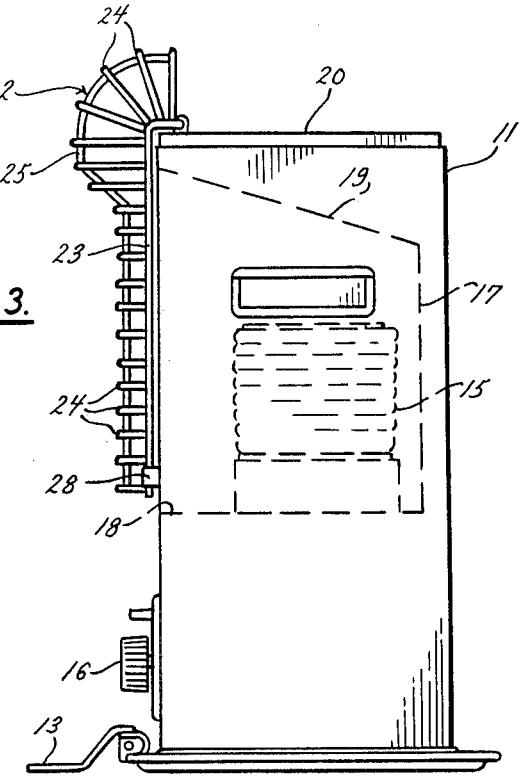
FIG. 3 is an elevational view of the right-hand end of the portable heating unit of FIG. 1.

DETAILED DESCRIPTION OF PREFERRED EMBODIMENTS:

Referring particularly to FIGS. 1–4 and 8, the numeral 11 denotes the housing of one preferred embodiment of portable heating unit which is made in accordance with the principles and teachings of the present invention. That housing is shown as being essentially rectangular in front elevation, in side elevation and in plan; and it has a large opening in the front thereof. That housing rests on a base 12 of standard and usual design which is formed to constitute a well for any liquid fuel which may leak out of the portable heating unit. An extension 13 is pivotally secured to the front of the base 12; and that extension is intended to keep the front of the housing 11 from being positioned closely adjacent a wall, a piece of furniture or the like. That portable heating unit has a combustion unit, not shown, of standard and usual design which includes a wick guide, a wick, a mechanism to raise or lower the wick, and a support for a heat-radiating unit 15. In addition, that portable heating unit has a storage tank, not shown, for liquid fuel which automatically keeps the tank of the combustion unit filled to a predetermined level. The heat-radiating unit 15 normally is held in the position indicated by FIGS. 2, 3 and 8, adjacent the center of a heating chamber; and that heating chamber has an arcuate, vertically-directed wall 17, a bottom 18 with a central opening to accommodate the combustion unit, and a top 19 which inclines upwardly and forwardly toward the opening in the front of the housing 11. Heat that is radiated from the heat-radiating unit 15 can pass directly forwardly through the opening in the front of the housing 11, can be reflected by the arcuate wall 17 through that open front, and also can be reflected from the inclined top 19 through that open front.

The numeral 16 denotes a knob which can be rotated to effect the raising or lowering of the wick within the combustion unit. As shown particularly by FIGS. 2–4, that knob projects forwardly from the lower portion of the front of the housing 11. The portable heating unit also is provided with standard and usual safety devices which automatically retract the wick within the combustion unit in the event the portable heating unit is tilted over or is struck by a blow which is sufficiently severe to dislodge the heat-radiating unit 15 from its normal position on that combustion unit. When the wick in its upper position, it extends into the lower part of the heat-radiating unit 15; and the heat which is generated by the burning of the liquid fuel, that is supplied by that wick, is radiated by that heat-radiating unit.

Figure 4:
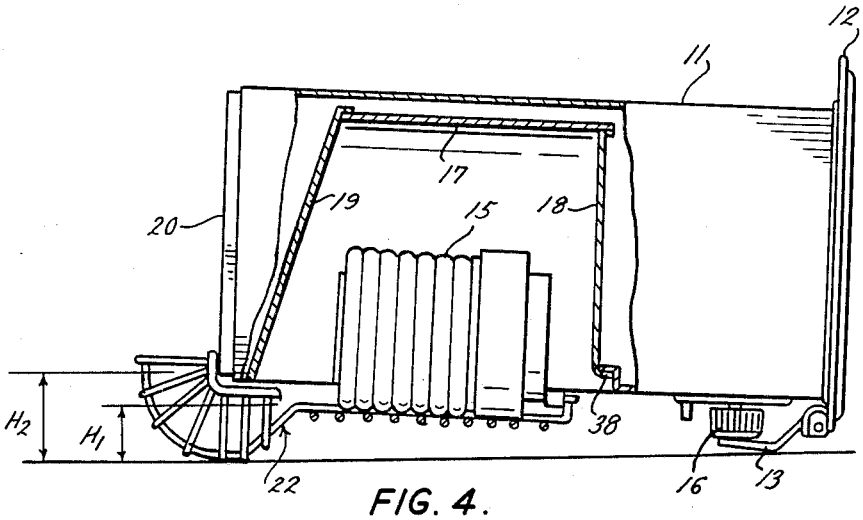
FIG. 4 is a partially-sectioned view showing the portable heating unit of FIG. 1 tilted forwardly facing the floor and showing the heat-radiating unit thereof resting on the grid-like guard of that portable heating unit.
Figure 8:
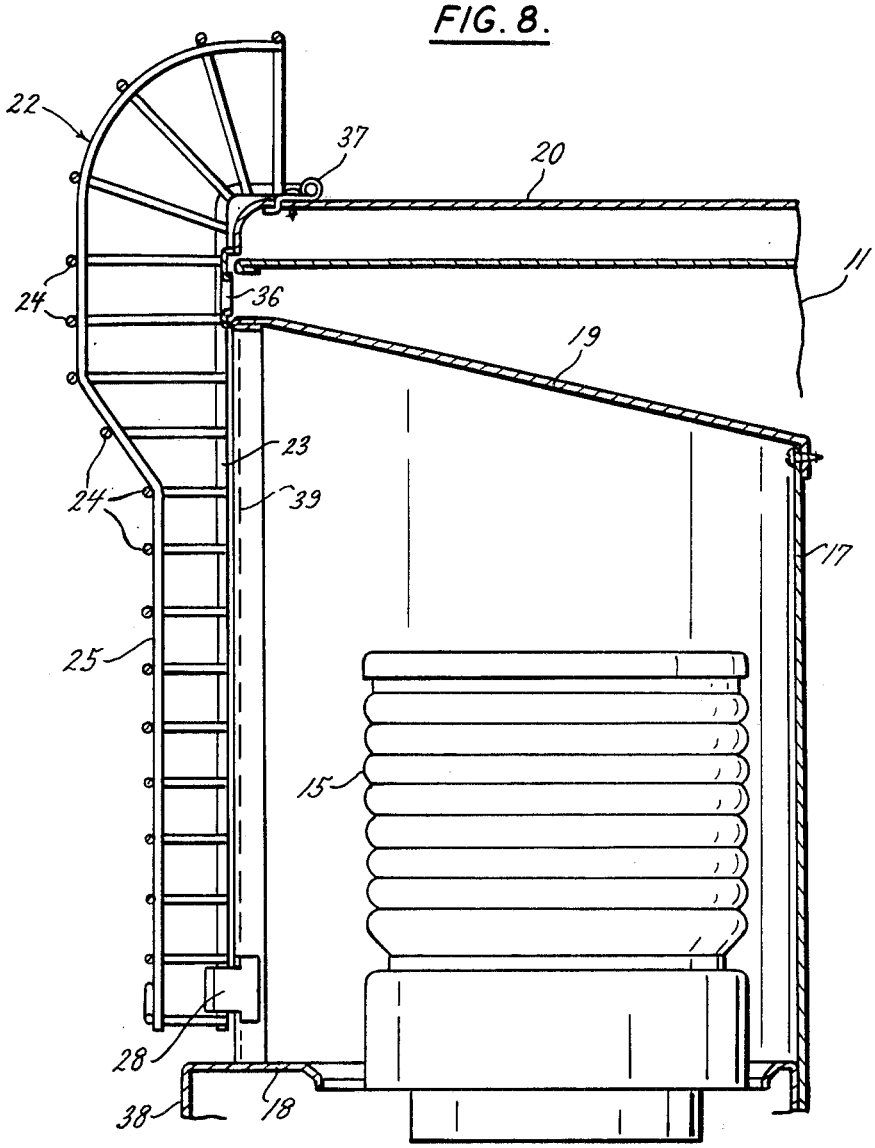
FIG. 8 is a vertical section, on a larger scale, through the portable heating unit of FIG. 1.
Figure 9:
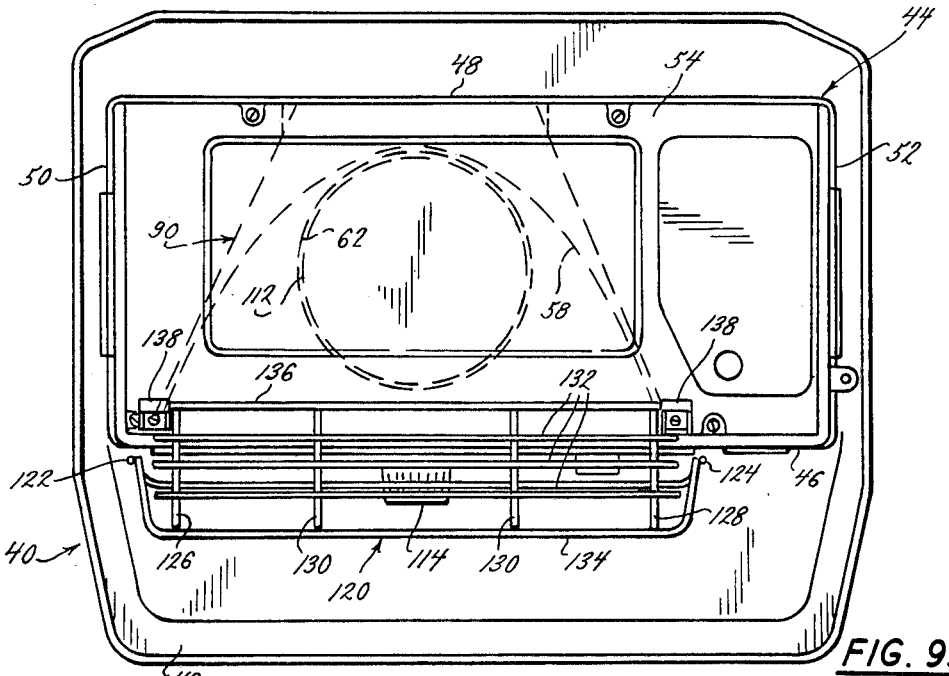
FIG. 9 is a plan view of a third preferred embodiment of portable heating unit which is made in accordance with the principles and teachings of the present invention.

As indicated particularly by FIGS. 4 and 8, substantially all portions of the exterior of the arcuate wall 17 and of the top 19 are spaced inwardly from the inner surfaces of the wall and of the top 20 of the housing 11 to define an air space. An air inlet 34 adjacent the bottom of the front of the housing 11 permits air to enter that housing and move upwardly into that air space, and air outlets 36 adjacent the top of the front of the housing 11 permit air to issue from that air space. That air will move along in engagement with substantial portions of the exterior of the wall 17 and of the top 19 of the heating chamber, and it will absorb heat from that wall and that top and carry that heat outwardly through the air outlets 36. In addition, the air moving through the air space will absorb heat which is radiated by the wall 17 and by the top 19, and which otherwise would impinge upon the inner surfaces of the walls and of the top 20 of the housing 11; and that air will carry that heat out through the air outlets 36.

The heating chamber is secured in position within the housing 11 by a flange 38 on the forward edge of the bottom 18 and by flanges 39 at the forward edges of the arcuate wall 17, as indicated by FIG. 8. The metal of which the wall 17 and the base 18 are made is quite thin, preferably less than two millimeters; and hence the cross sections of those flanges are quite small. As a result, the amount of heat which can be conducted from the heating chamber to the housing 11 is quite limited. Also, because the flanges 38 and 39 are adjacent the front of the heating chamber, little or no heat is conducted directly from other portions of that heating chamber to the housing 11—the conduction of such heat having to be to and through those small cross section flanges.

The numeral 22 generally denotes a grid-like guard which is disposed in register with the opening in the front of the housing 11. That guard has vertically-directed wires 23 at the sides thereof, has intermediate vertically-directed wires 25, and has a considerable number of horizontally-directed wires 24 which are straight throughout the major portions of their lengths but which have bends adjacent the ends thereof that enable those ends to extend to the side wires 23. As shown particularly by FIGS. 1, 3, 4 and 8, the side wires 23 have the upper ends thereof disposed at right angles to the major portions of the lengths thereof so those upper ends extend rearwardly beyond the front of the housing 11 to overlie portions of the front of the top 20 of that housing. As shown particularly by FIGS. 3, 4 and 8, the intermediate wires 25 have the upper ends thereof successively inclined forwardly, directed upwardly, and bowed upwardly and rearwardly to enable the guard to provide a section at the top thereof which protrudes forwardly beyond and above the rest of that guard. Horizontally-directed wires 33 adjacent the bottom of the guard 22 have re-entrant ends which are secured to the bottoms of the intermediate wires 25; and the wires 33 have their outer ends extending to the side wires 23. Retaining elements 28 adjacent the lower portion of the opening in the front of the housing 11 coact with retaining elements 37 on the front portion of the top 20 of that housing to secure the guard 22 in position adjacent that front opening. As indicated particularly by FIGS. 2, 4 and 8, the guard 22 overlies substantially all of the front of the combustion chamber, overlies the air outlet openings 36, and also overlies part of the top 20 of the housing 11. Further, FIGS. 4 and 8 show that the lower end of the guard 22 is so close to the bottom 18 that it will substantially prevent accidental engagement between persons or objects and the heat-radiating unit 15 or the combustion unit which supports that heat-radiating unit.

The forwardly-protruding upper portion of the guard 22 performs several useful functions: first, it will substantially prevent accidental engagement between persons or objects and any of the air outlets 36 or the front of the top 19 of the heating chamber or the front of the top 11 of the housing; second, it will keep the planar portion of that guard a predetermined minimum distance away from the floor or from a floor covering thereon in the event the housing 11 were to be tilted over on its face; and third, it will keep persons and objects a substantial distance away from the heated air which issues from the air outlets. Specifically, as indicated by FIG. 4, the forwardly-protruding upper portion of the guard 22 will hold the upper end of the planar section of that guard away from the floor, or from a covering thereon, by a distance "$H_1$", and it will keep the upper portion of the opening in the front of the housing 11 away from that floor or that covering by a distance "$H_2$". Consequently, even if the heat radiating unit 15 of the portable heating unit were to become dislodged from its normal position atop the combustion unit, and were to fall forwardly toward the floor, or the covering thereon, the planar section of the guard 22 would intercept that heat-radiating unit and would hold it a predetermined minimum distance away from that floor or that covering. Also, that forwardly-protruding upper portion of the guard would hold the forward edge of the top 19 of the combustion chamber an even larger predetermined minimum distance away from that floor or that covering. In addition, the planar portion of the grid 22 will act to help cool that heat-radiating unit 15 by absorbing heat from that unit; and hence the heat-radiating unit will be able to cool without igniting the floor or the covering thereon. The overall result is that the portable heating unit can be used with virtually no risk of causing a fire even if that portable heating unit were to be tilted over so it came to rest facing the floor or the covering thereon.

It should be noted that the air which issues from the air outlets 36 will move forwardly and upwardly past the front of the top 20 of the housing 11; and, as it does so, it will move the products of combustion which issue from the upper part of the combustion chamber outwardly away from the front of that housing. As a result, those products of combustion will not be able to impart as much heat to the front of the housing 11 as they would if they were permitted to move directly upwardly into engagement with the front of that housing.

Referring particularly to FIGS. 5 and 7, a portable heating unit is shown which is very similar to the portable heating unit of in FIGS. 1–4 and 8. The portable heating unit of FIGS. 5–7 differs from the portable heating unit of FIGS. 1–4 and 8 in having a fan housing 27 mounted adjacent an opening in the rear wall of the housing 11. A motor-driven fan, which is protected by that fan housing, can direct cool air into the air space between the exterior surfaces of the wall and of the top of the heating chamber and the inner surfaces of the walls and of the top 20 of the housing 11. By forcing air to move through that air space and out of the air outlets, not shown, adjacent the top of the heating chamber, more heat is absorbed from the wall and top of that heating chamber and more of the heat radiated from that wall and top can be removed, than where convection is depended upon to move air through that air space. Another difference between the portable heating unit of FIGS. 5 and 7 and the portable heating unit of FIGS. 1–4 and 8 is the base 12; because that base has a longer front-to-rear dimension than does the base 12 in FIGS. 1–4. In fact, the front-to-rear dimension of the base 12 of the portable heating unit of fIG. 5 is essentially equal to the combined front-to-rear distances of base 12 and of the extension 13 of FIGS. 1–4.

FIG. 6 shows a shipping container 30A that has pre-formed, or compressible, packing 31A in the bottom thereof which can accommodate the bottom of the housing 11. That container has pre-formed, or compressible, packing 32A in the top thereof to accommodate the rear portion of the top 20 of that housing. The packings 31A and 32A will hold the housing 11 within the shipping container 30A so the fan housing 27 is displaced inwardly from the rear wall of that container, so the forwardly and upwardly protruding upper portion of the guard 22 is displaced inwardly from the front and top of that container, and so the knob 16 is displaced inwardly from the front wall of that container. More specifically, the distance from the top 20 of the housing 11 to the top of the forwardly and upwardly protruding upper portion of the guard 22 is the distance "h" and the packing 32A will space the top 20 from the top of container 30A by a distance greater than "h". The base 12 is dimensioned to fit between the side of housing 11 which is shown in FIG. 6 and the side of container 30A which encloses that side of housing 11. That base will be turned so its narrow dimension is aligned with the bottom of container 30A and so its long dimension is aligned with the side of that container. A thin layer of packing material will be placed over the side of the housing 11 which is shown in FIG. 6 to keep the base 12 from engaging that side during shipment of the portable heating unit.

FIG. 7 shows a shipping container 30B which is just slightly deeper, and is shorter, than the shipping container 30A. Packing 31B in the bottom of container 30B is generally similar to the packing 31A, but it has a slightly greater front-to-rear dimension. Packing 32B in the top of container 30B is shallower than the packing 32A; but it extends from the front of the rear of container 30B. The guard 22 is separated from the housing 11 before that housing and guard are placed in the shipping container 30B; and a thin layer of packing material, not shown, will be used to separate that guard from the fan housing 27 and from the rear wall of housing 11. A further thin layer of packing material, not shown, will be interposed between the guard 22 and the rear wall of container 30B. The base 12 will again be turned so its short dimension is parallel to the bottom of the container; and a thin layer of packing material will be interposed between that base and the side of housing 11 which is visible in FIG. 7.

The packing in each of the shipping containers 30A and 30B will hold the housing 11, the guard 22 and the base 12 in fixed position during storage and shipment. Also, that packing will protect that housing, that guard and that base from contacting or rubbing against each other during storage and shipment. Yet, the depths and heights of those containers are only slightly greater than the combined depths and heights of housing 11 and guard 22.

Referring particularly to FIGS. 9–13, the numeral 40 generally denotes a third preferred embodiment of portable heating unit that is made in accordance with the principles and teachings of the present invention. That portable heating unit has a housing which is generally denoted by the numeral 44 and which rests upon a base 42 of standard and usual design. That housing has a front wall 46 with a large opening therein, has a rear wall 48, has a left-hand side wall 50, has a right-hand side wall 52, and has a top 54. That housing is generally rectangular in front elevation, side elevation and plan.

Figure 11:
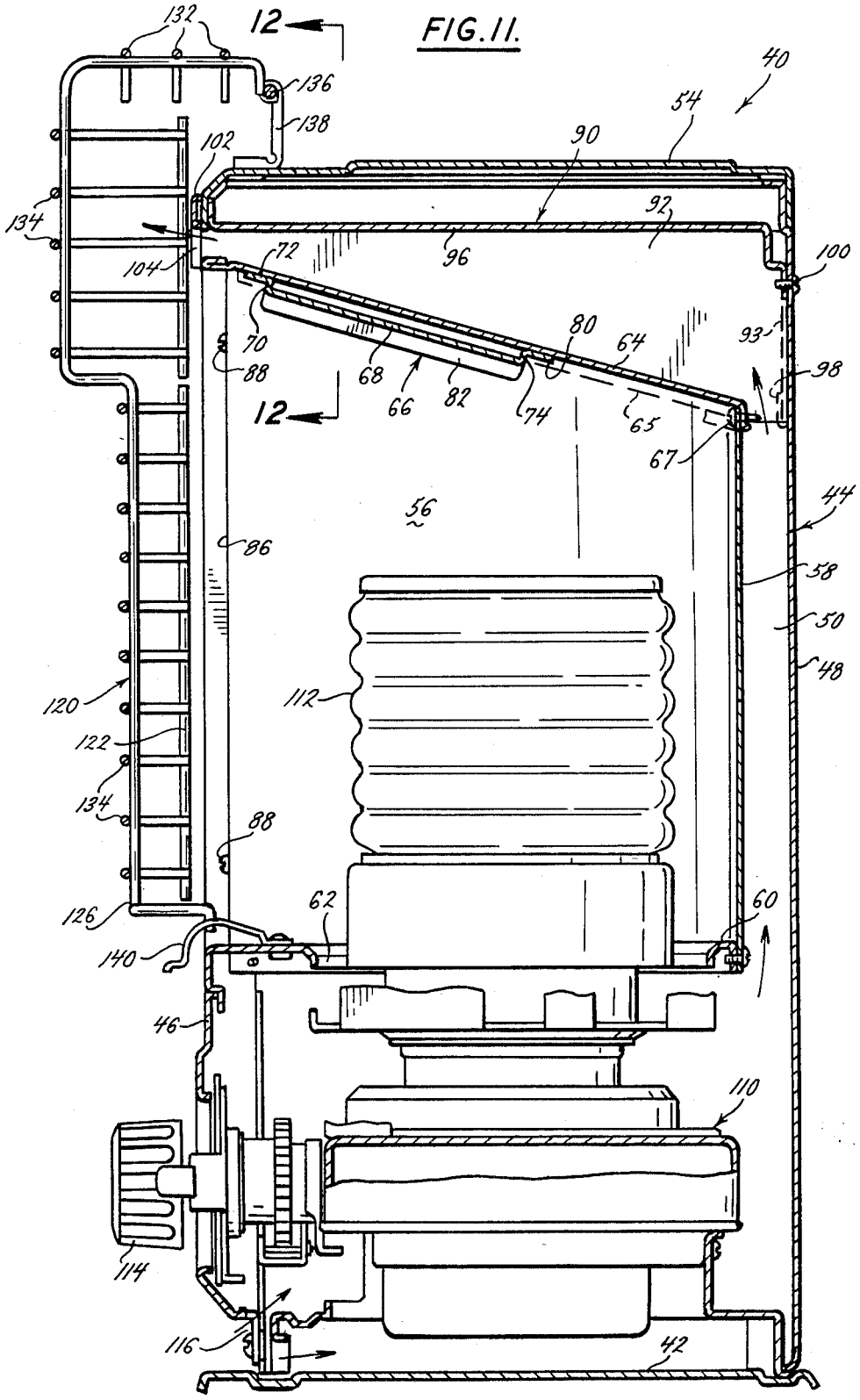
FIG. 11 is a vertical section, on a larger scale, through the portable heating unit of FIG. 9.

The numeral 56 in FIG. 11 generally denotes a heating chamber which is mounted within the housing 44 in register with the opening in the front of that housing. That heating chamber has a generally-vertical, arcuate wall 58, a bottom 60 with an opening 62 therein, and a top 64 with downwardly-offset, outwardly-extending flanges 65 with re-entrant edges at the opposite sides thereof, as shown particularly by FIGS. 12 and 13. The top 64 is held in assembled relation with the wall 58 by a screw 67 at the upper portion of the rear of that wall, as shown by FIG. 11; and it also is held in assembled relation with that wall by frictional forces between the upper edge of that wall and the flanges 65 on that top. When the wall 58 is in its unstressed condition, flanges 86 at the forward ends of that wall are spaced further apart than the front ends of the flanges 65. Consequently, whenever the wall 58 is bowed to enable the upper portions thereof to fit between the flanges 65, the resulting frictional and compressive forces help maintain the top 64 in assembled relation with that wall.

The numeral 66 generally denotes a baffle-interceptor which has an upwardly-extending flange 70 and a foot 72 adjacent the front thereof and has an upwardly-extending flange 74 and a foot 80 adjacent the rear thereof. Those flanges hold a central planar portion 68 below, and in register with, the forward central portion of the top 64. Downwardly-directed flanges 82 and 84 are provided at the opposite sides of that central planar portion; and they generally parallel the sides of the housing 44. The feet 72 and 80 are secured to the top 64 by spot welds, rivets or other fastening means.

Figure 10:
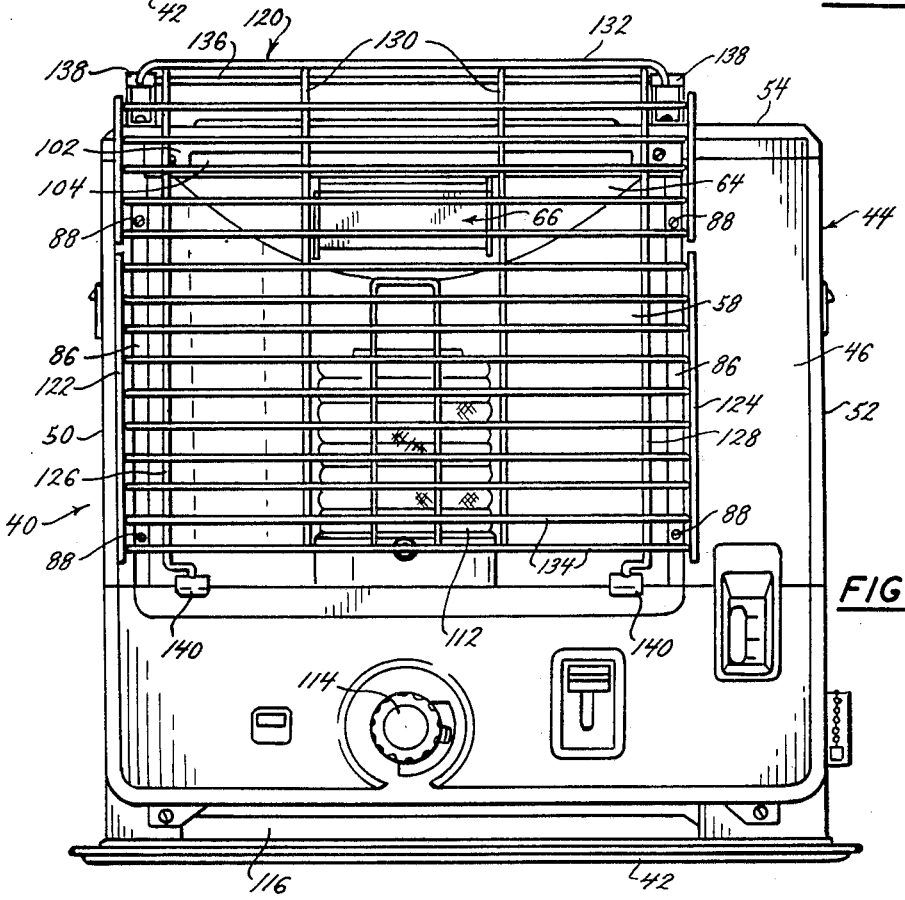
FIG. 10 is a front elevational view of the portable heating unit of FIG. 9.
Figure 13:
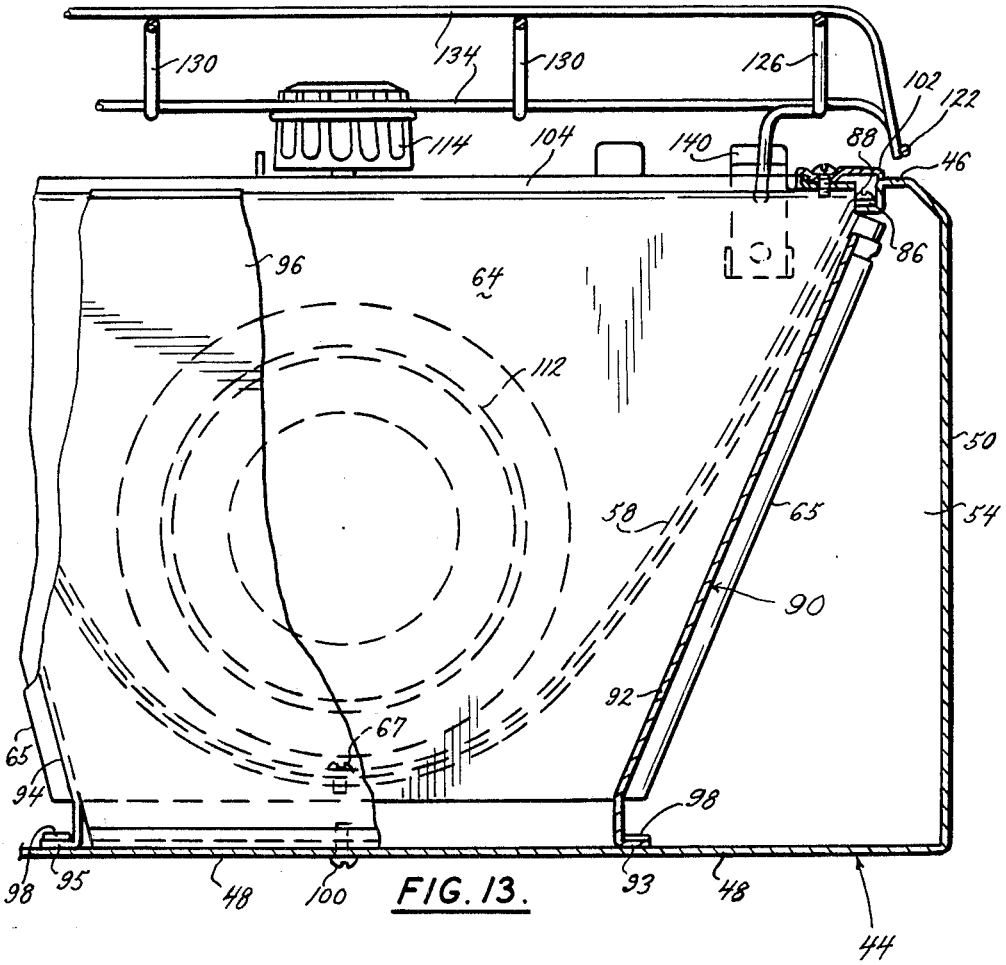
FIG. 13 is a partially-broken away, partially-sectioned view, on the scale of FIG. 12, which is taken along a plane indicated by the line 13—13 in FIG. 12.

The flanges 86 at the forward edges of the wall 58 abut inwardly-bent portions of the front 46 of the housing 44, as shown particularly by FIG. 13. Screws 88 extend through openings in those flanges and seat in those inwardly-bent portions to secure the wall 58 of the heating chamber to the housing 44. As shown by FIG. 10, those flanges are exposed adjacent the front of the housing 44 and hence can freely radiate heat conducted to them from the wall 58.

The numeral 90 in FIG. 11 generally denotes an air duct which is frusto-triangular in plan, as shown particularly by FIG. 13. That air duct has side walls 92 and 94 which are shallow adjacent the front ends thereof and which are deep adjacent the rear ends thereof. A flange 93 at the rear end of the side wall 92 is held by an L-shaped bracket 98 which is punched forwardly out of the rear wall 48 of the housing 44; and a flange 95 at the rear end of the side wall 94 is held by a similar L-shaped bracket 98. The top 96 and the side walls of the air duct 90 coact with the top 64 of the heating chamber to direct air over the top 64 to absorb heat from that top and also to absorb heat which is radiated from that top. Further, the top 96 of the air duct 90 coacts with the top 54 and the with upper portions of the sides of the housing 44 to define an air space wherein air will limit the amount of heat which can be transferred from the top 96 to the top 54. The air duct 90 is secured in position by the engagement of the flanges 93 and 95 with the L-shaped brackets 98, and also by a screw 100 which passes inwardly through the wall 48 and seats in a downwardly-extending portion of the top 96 of that air duct.

The numeral 102 denotes a trim member which overlies the top of the front of the housing 44. That trim member has an elongated opening 104 in register with the forward end of the air duct 90; and that elongated opening serves as an outlet for the air within the air space defined by the top 96 of that air duct and by the top 54 and upper portions of the sides of housing 44.

The numeral 110 generally denotes the combustion unit for the portable heating unit. The numeral 112 denotes the heat-radiating unit which normally is disposed in position atop that combustion unit. A knob 114 is usable to raise and lower a wick, not shown, relative to the heat-radiating unit 112. The numeral 116 denotes an air inlet adjacent the bottom of the front of the housing 44 through which air can enter the air space (a) between the exterior of the wall 58 of the heating chamber 56 and the inner surfaces of housing 44 and (b) between the top 96 of air duct 90 and the top 54 of housing 44.

The numeral 120 denotes a grid-like guard which is generally similar to the guard 22 of FIGS. 1–4 and 8. The guard 120 has a left-hand vertical wire 122, a right-hand vertical wire 124, a left-hand support wire 126, a right-hand support wire 128, and intermediate vertical wires 130. The left-hand and right-hand vertical wires 122 and 124 are straight throughout their lengths; but the upper portions of the wires 126, 128 and 130 are bent forwardly, upwardly, and rearwardly, as shown particularly by FIG. 11. The bottom ends of the wires 126 and 128 are bent rearwardly and downwardly, as shown particularly by FIGS. 10 and 11; and those inwardly and downwardly bent ends are held by openings in spring-type retaining elements 140. Horizontally-directed wires 132 are secured to the rearwardly-bent upper portions of the wires 126, 128 and 130; and the opposite ends of those horizontal wires are bent downwardly, as indicated particularly by FIG. 10. Horizontally-directed wires 134 are secured to the vertically-directed upper portions of the wires 126, 128 and 130; and the ends of those wires are bent rearwardly to be secured to the left-hand and right-hand vertically-directed wires 122, as shown particularly by FIGS. 9 and 11.

A pivot wire 136 is secured to the rear portions of the upper ends of the wires 126, 128 and 130. L-shaped brackets 138, which are secured to the top 54 of the housing 44, pivotally hold the pivot wire 136—and thereby hold the upper portion of the guard 120. Whenever it is desirable to reach into the heating chamber, it is only necessary to press downwardly on the springy retaining elements 140 to release the lower ends of the guard 120, and then to rotate that guard in the clockwise direction in FIG. 11 until it rests upon the top 54 of the housing 44.

The operation of the portable heating unit of FIGS. 9–13 will be generally the same as the operation of the portable heating unit in FIGS. 1–4 and 8. However, the central planar portion 68 of the baffle-interceptor 66 wil shield a substantial portion of the top 64 of the heating chamber from direct contact with products of combustion rising from the heat-radiating unit 112. Also, the flanges 82 and 84 at the sides of that central planar portion will keep products of combustion, which do strike that central planar portion, from moving laterally outwardly beyond that planar portion and then turning upwardly to engage the adjacent portions of the top 64. Those flanges will guide such products of combustion forwardly toward the open front of the heating chamber 56. In addition, the flange 74 will act as a flame interceptor. If, as sometimes happens, a flame rises upwardly from the heat-radiating unit 112 while the wick is being raised by movement of the knob 114, that flame should, at least in part, be intercepted by the flange 74.

By intercepting products of combustion from the heat-radiating unit 112, the central planar portion 68 of the baffle-interceptor 66 reduces the amount of heat which those products of combustion can apply directly to the top 64 of the combustion chamber 56. Also, because the flanges 70 and 74 have small cross sections, only limited amounts of heat will be conducted from the planar central portion 68 to the top 64. Further, because the space between that top and that central planar section is open at each side, heated air can escape from that space and carry away heat which otherwise would be radiated toward the top 64 by the upper surface of the central planar section 68.

Figure 14:
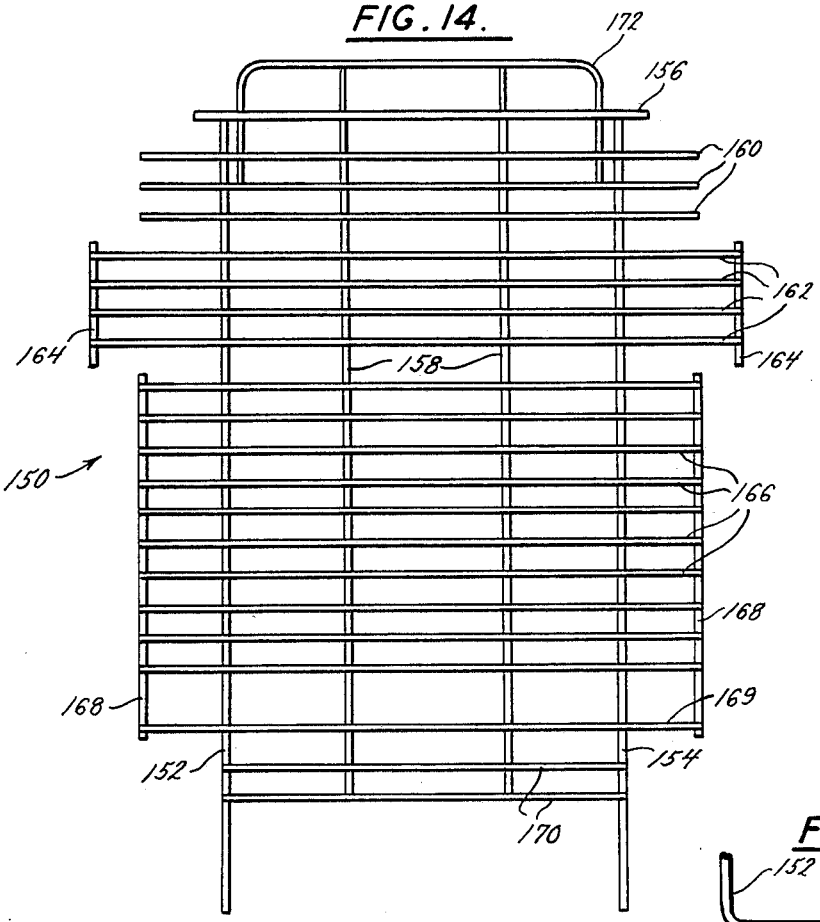
FIG. 14 is a front elevational view of a grid-like guard which can be substituted for the guard of the portable heating unit of FIGS. 9–13, and it shows that grid-like guard in its planar condition.
Figure 17:
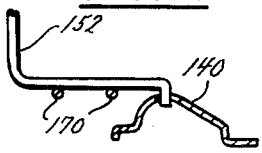
FIG. 17 is a side elevational view of the lower portion of the grid-like guard of FIG. 14 after that lower portion has been bent to the desired configuration and has been assembled with a resilient retaining element of the portable heating unit of FIG. 15.

Referring particularly to FIG. 14, the numeral 150 generally denotes a guard which is very similar to the guard 120 of FIGS. 9–13. The guard 150 has vertically-directed support wires 152 and 154 which have lower ends that can bent inwardly and downwardly. A pivot wire 156 is secured to the upper ends of the vertically-directed support wires 152 and 154; and vertically-directed intermediate wires 158 also are secured to that pivot wire. Horizontally-directed wires 160 are secured to upper portions of the wires 152, 154 and 158; and the ends of those horizontally-directed wires extend outwardly beyond the support wires 152 and 154. Further horizontally-directed wires 162 are secured to the wires 152, 154 and 158 and those wires are longer than the wires 160. End wires 164 are secured to the outer ends of the wires 162. Further horizontally-directed wires 166 are secured to the wires 152, 154 and 158; and those wires are about the same length as the wires 160. The ends of the wires 166 project outwardly beyond the wires 152 and 154; and end wires 168 are secured to those projecting ends. A still further horizontally-directed wire 169 is secured to the wires 152, 154 and 158 and also to the end wires 168. Shorter horizontally-directed wires 170 are secured to the wires 152, 154 and 158; and a generally U-shaped extension 172 is secured to pivot wire 156 and to the uppermost two horizontally-directed wires 160.

The various wires of the guard 150 are secured together by spot welds or other means; and all of those wires coact to form an initially-flat grid-like guard. However, after all of the various wires have been secured together, the guard 150 is bent so the horizontally-directed wires 160 define a horizontally-directed plane which is above the level of the top of the housing 44 in FIGS. 15 and 16, and so the central portions of the horizontally-directed wires 162 define a plane which is essentially vertical and which extends from a level below the level of the air outlet 104 to a level above the top of the housing 44. The central portions of the horizontally-directed wires 166 define a vertical plane which is displaced rearwardly of the vertical plane which is defined by the central portions of the horizontally-directed wires 162; and the vertical plane defined by the central portions of the wires 166 will be comparable to the vertical plane defined by the central portions of the wires 134 in FIG. 11. The horizontally-directed wires 170 define a plane which is above, but close to, the level of the bottom 60 of the heating chamber of FIG. 11. The lower ends of the wires 152 and 154 will be bent inwardly toward each other and then bent rearwardly in parallel relation with each other, and will have the innermost portions thereof bent downwardly to provide the inwardly-offset arrangements for the lower ends of those wires which is similar to the inwardly-offset arrangements for the lower ends of the wires 126 and 128 of the guard 120 in FIG. 10.

The extension 172 projects rearwardly from the L-shaped brackets 138 which hold the guard 150; and that extension will hold persons and objects away from the forward portions of the top 54 of the housing 44. The horizontally-directed wires 170 will hold persons and objects away from the lower portions of the front of the heating chamber 56. The intervening portions of the guard 150 will hold persons and objects away from the trim member 102 and the air outlet 104, and away from the rest of the front of the heating chamber 56.

The hinging of the guard 150 adjacent the top of the housing 44, like the hinging of the guard 120 adjacent the top of the housing 44 of FIGS. 9–13, is desirable because it enables that guard to respond to the force of gravity to remain close to the front of that housing. As a result, that guard will tend to remain in guarding position even if the user fails to use the springy retaining elements 140 to hold the lower end of that guard.

Figure 18:
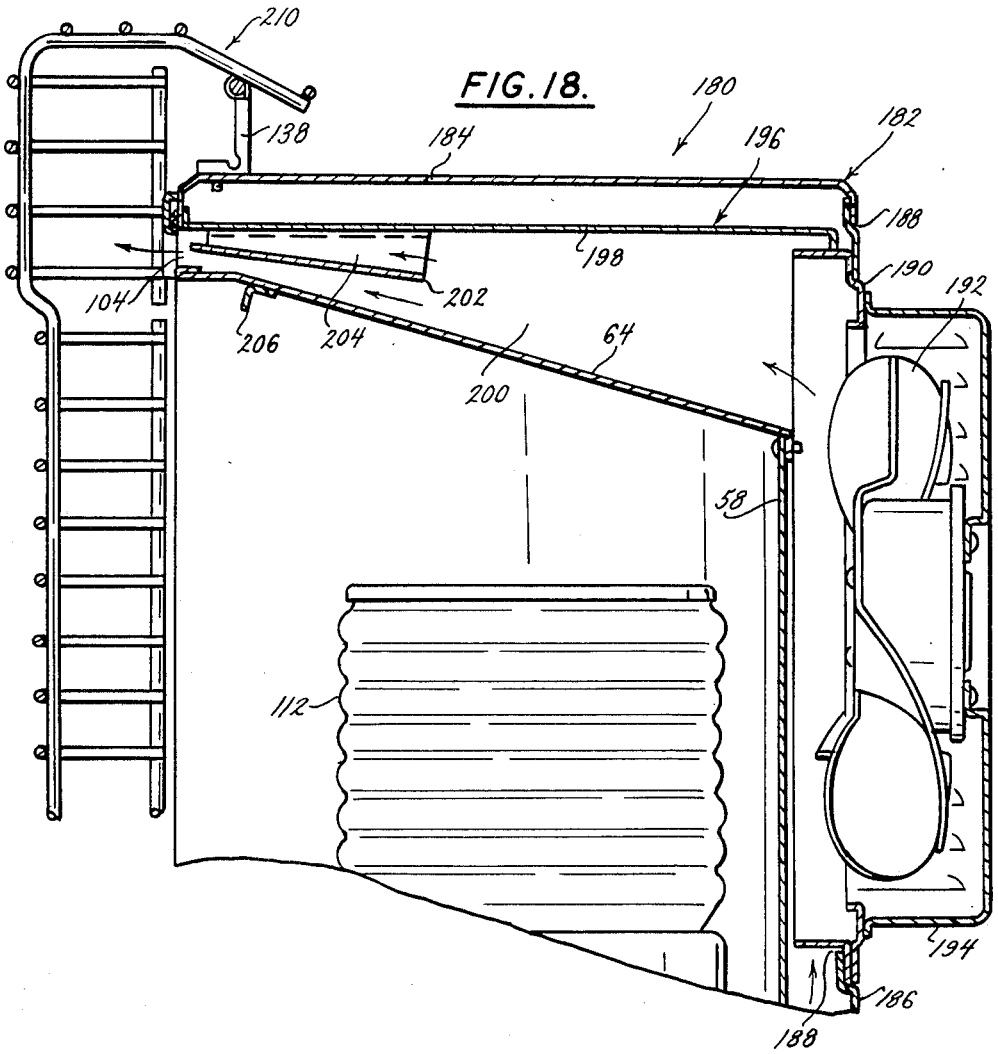
FIG. 18 is a vertical section through the upper part of a fourth preferred embodiment of portable heating unit which is made in accordance with the principles and teachings of the present invention.
Figure 19:
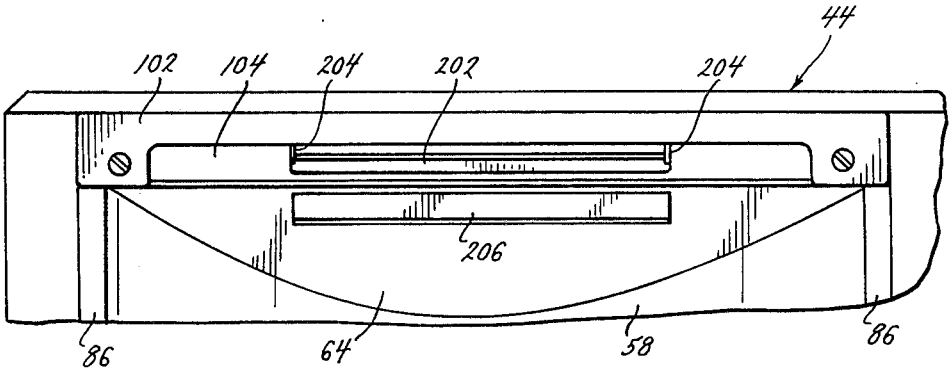
FIG. 19 is a front elevational view of the upper portion of the heating chamber of the portable heating unit of FIG. 19.

Referring particularly to FIG. 18, the numeral 180 generally denotes a fourth preferred embodiment of portable heating unit that is made in accordance with the principles and teachings of the present invention. The top 64 of the heating chamber of that portable heating unit differs from the top 64 of the heating chamber 56 of the portable heating unit of FIGS. 9–13 in having a flame interceptor 206 of L-shaped configuration adjacent the front thereof, and in not having a baffle-interceptor 66. However, the portable heating unit 180 has an air duct 196 which has the top 198 thereof equipped with a baffle 202 that has flanges 204 which extend upwardly toward, and which are secured to, that top. The top 198 and the sides 200 of that air duct will guide air, from a motor-driven fan 192, forwardly to and through the air outlet 104 which is adjacent the front of the housing 182 of the portable heating unit 180. The top 184 of the housing 182 is spaced from the top 198 of the air duct 196; and the resulting air space will limit transfer of heat from the top 198 to the top 184.

The rear wall 186 of the housing 182 has an opening 188 in which the casing 190 for the motor-driven fan 192 is mounted. A guard 194, of standard and usual design, protects and encloses that motor-driven fan. That motor-driven fan will be similar to, and will perform the functions of, the motor-driven fan 27 of FIGS. 5–7. That fan will force air to move into engagement with, and then along, the exteriors of wall 58 and top 64 of the heating chamber of the portable heating unit. That air will absorb substantial amounts of heat from those exteriors, will absorb substantial amounts of heat radiated by those exteriors, and also will force the products of combustion from the heating chamber to move outwardly beyond the front of the upper portion of the top 184 of the housing 182. As a result, that air will substantially limit the temperature rise of all portions of the housing 182. In fact, that air will help hold the temperature of all portions of the housing 182 below eighty-two degrees Centigrade (82° C.)—even when the heat-radiating unit 112 is producing its maximum rated heat.

The baffle 202 will intercept heat that is radiated by the portion of top 64 adjacent the flame interceptor 206. As a result, any tendency of that portion of top 64 to heat the front portion of the top 198 of the air duct 196 will be limited by the baffle 202 and also by the air which the motor-driven fan 192 moves over, under, and in contact with that baffle. Also, because the sides 204 of that baffle have large surface-to-volume ratios, those sides will readily transfer heat to the air which passes by them, and thereby will limit the amount of heat they will conduct to the top 198.

The motor-driven fan 192 enables all portions of the housing 182, which are not protected by a guard 210, to remain at temperatures below eighty-two degrees Centigrade (82° C.). However, even in the portable heating units of FIGS. 1–4 and 8, FIGS. 9–13 and 15–17, where a fan is not provided, all portions of the housing 182 which are not protected by a guard will remain below the temperature at which water boils.

Figure 15:
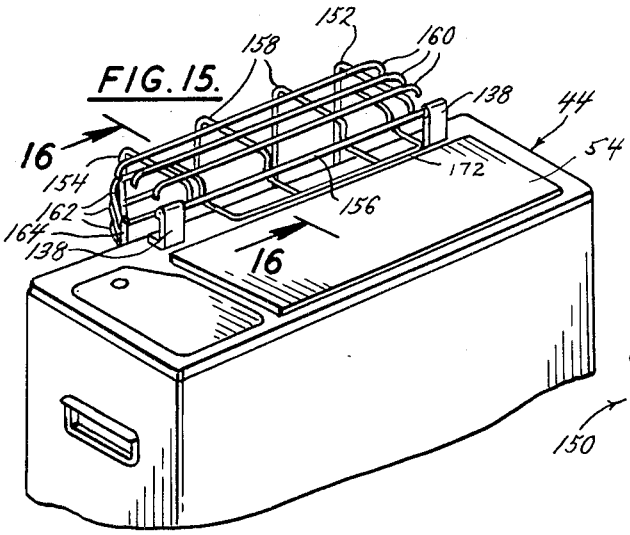
FIG. 15 is a perspective rear view of the grid-like guard of FIG. 14 after it has been bent to the desired shape and has been assembled with the portable heating unit of FIGS. 9–13.
Figure 16:
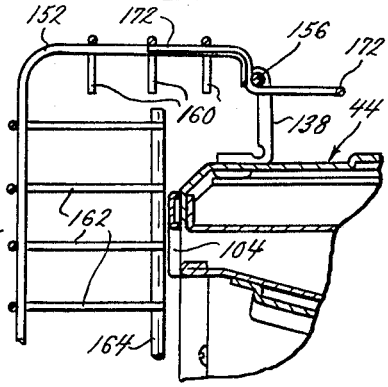
FIG. 16 is a sectional view, on a scale larger than that of FIG. 15, and it is taken along a plane indicated by the line 16—16 in FIG. 15.

The guard 210 resembles the guard 150 of FIGS. 14–17. However, it will be noted that the portion of guard 210 which is immediately adjacent the upper portions of the L-shaped barckets 138 is inclined downwardly and rearwardly relative to the top 184 of the housing 182. Such an inclination can dispose the closed end of the extension 172 of that guard closer to the top 184 than is the case where that extension is horizontal throughout, as shown in FIGS. 15 and 16.

The flame interceptor 206 will largely intercept any flame which might tend to develop, and rise upwardly from the heat-radiating unit 112, as the wick was being raised. That flame would initially strike the under surface of the top 64 of the heating chamber, and then would move forwardly toward the front of that heating chamber; but that flame would be largely intercepted by the flame interceptor 206.

Figure 20:
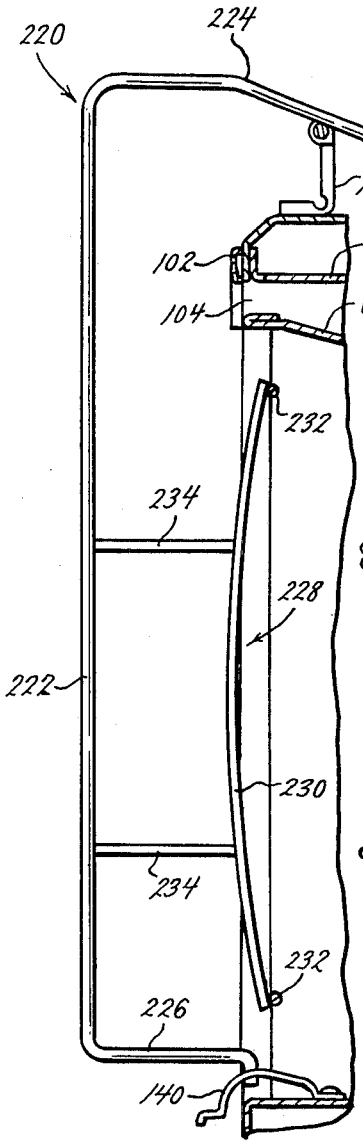
FIG. 20 is a side elevational view of a further grid-like guard for the portable heating unit of FIGS. 9–13.
Figure 21:
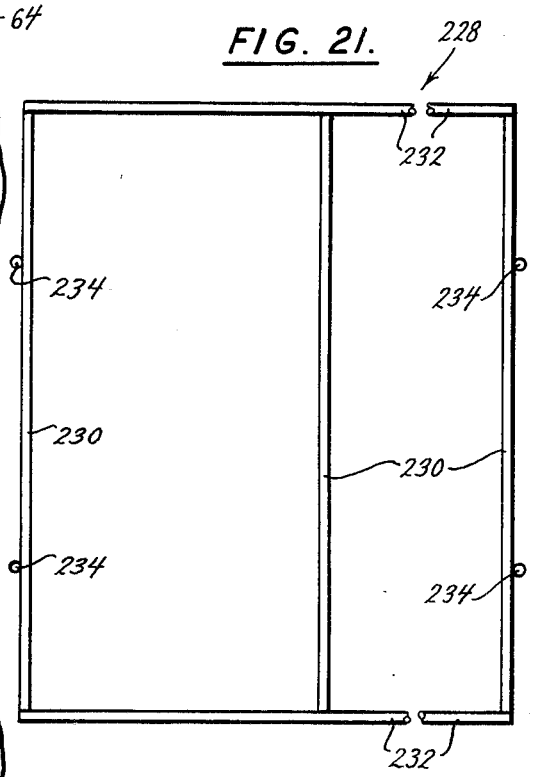
FIG. 21 is a rear elevational view of an intercepting grid which is part of the guard of FIG. 20.

Referring particularly to FIGS. 20 and 21, the numeral 220 generally denotes a further grid-like guard which could be used with the portable heating unit 180 of FIG. 18. That guard differs from the guard 210 of FIG. 18 in having the front portion thereof planar, as shown particularly by FIG. 20. The vertically-directed wire 222, which is representative of several vertically-directed wires that are spaced laterally across the front of the guard 220, has a rearwardly-extending portion 226 adjacent the bottom thereof to be releasably held by a springy retaining element 140. The guard 220 has a rearwardly and downwardly inclined portion 224 that will be adjacent the L-shaped brackets 138 of the portable heating unit 180 of FIG. 18 in the same manner in which the rearwardly and downwardly inclined portion of the guard 210 is adjacent those L-shaped brackets. The horizontally-extending wires for the guard 220 are not shown; but they will be located in about the same positions as the horizontally-directed wires at the top, bottom and intermediate portions of the guard 150 of FIGS. 14–17.

The guard 220 basically differs from the guards 22, 120, 150 and 210 by having an intercepting grid 228 as well as by having a planar front. The intercepting grid 228 has horizontally-directed wires 232 and vertically-directed wires 230 that are spaced rearwardly from the wires 222 by four spacing wires 234. The various wires 230, 232 and 234 are suitably spot welded or otherwise fixedly secured together.

As indicated particularly by FIG. 20, the wires 230 are arcuate in side elevation; and the wires 232 project inwardly from the ends of the wires 230. Further, the space between adjacent wires 230 is smaller than the diameter of the heat-radiating unit 112 of the portable heating unit with which the guard 220 will be used. Consequently, the intercepting grid 228 will intercept and hold that heat-radiating unit in the event the portable heating unit is tilted forwardly on its face.

In the event the portable heating unit was tilted forwardly on its face and the heat-radiating unit fell toward the intercepting grid 228 with its axis parallel to its normal position, that heat-radiating unit would engage the central wire 230 and then roll to the left or right until it was held by that central wire and by the left-hand or right-hand wire 230. On the other hand, if that heat-radiating unit were, somehow, to be caused to shift its axis about ninety degrees from its normal position, that heat-radiating unit would come to rest on two or more of the wires 230, and would then be cradled by the arcuate configurations of those wires. In either case, the heat-radiating unit would be held away from the planar portion of the guard 220 which might be engaging the floor or the floor covering. As a result, that heat-radiating unit would be held far enough away from the floor or the covering thereon to keep the heat of that heat-radiating unit from igniting that floor or that covering.

The flanges 86 at the forward edges of the wall 58 of the heating chamber 56 in FIGS. 10–13 are shown as continuous flanges. If desired, those flanges could be made with perforations along the lengths thereof, or those flanges could be replaced by fingers. In either event, the heat which could be conducted from the forward edges of the wall 58 to the adjacent portions of the housing 44 would be even less than the limited amounts of heat which can be conducted to those portions by the flanges 86.

Figure 12:
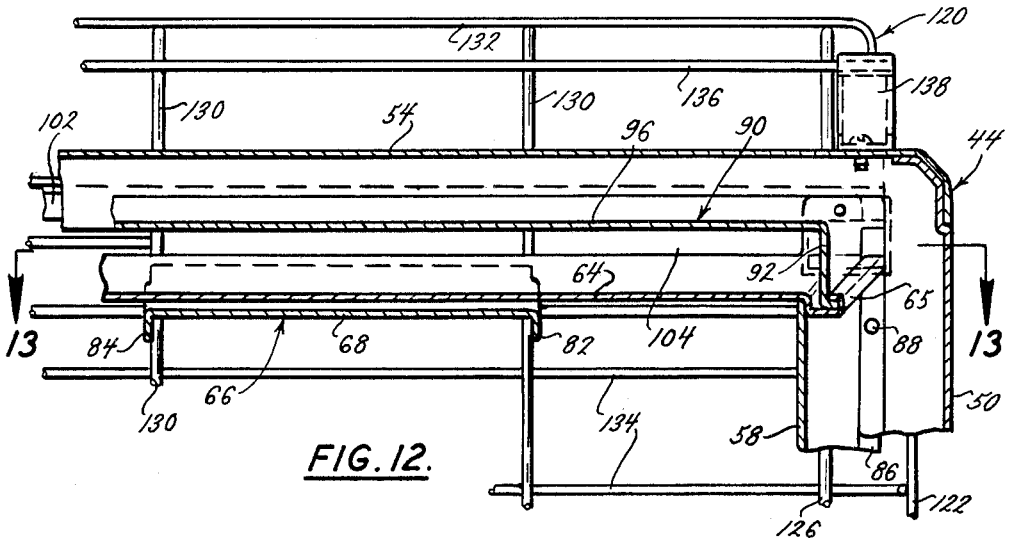
FIG. 12 is a sectional view, on a still larger scale, which is taken alone a plane indicated by the line 12—12 in FIG. 11.

If desired, the front flange 70 of the baffle-deflector 66 of FIGS. 10–12 could be replaced by one or more feet which would perform the function of holding the front edge of that baffle-deflector in fixedly-spaced relation below the corresponding portion of the top 64 of the heating chamber 56. In such event, freer movement of hot air through the space between the upper surface of that baffle-deflector and the bottom surface of the top 64 would result. Consequently, the replacement of that front flange with fingers could reduce the amount of heat transferred from that baffle-interceptor to that top.

If desired, the baffle-deflector 66 in FIG. 11 could be made so it was held in cantilever fashion by the foot 80 on the rear flange 74. Such an arrangement would permit even freer movement of hot air from the space between the upper surface of the planar central portion 68 of that baffle-deflector and the under surface of the top 64. However, such a construction would not be as sturdy as the construction shown in FIG. 11 or the construction where one or more feet were substituted for the front flange 70.

Where a portable heating unit is intended to generate only a limited amount of heat, namely, less than 9,000 BTU, the top of the heating chamber can be made as shown in FIG. 4 without a baffle-interceptor or a flame interceptor on the under surface thereof. However, portable heating units which are intended to generate more than that amount of heat should be equipped with a baffle-interceptor similar to the baffle-interceptor 66 or with a flame interceptor similar to the flame interceptor 206.

Whereas the drawing and accompanying description have shown and described several preferred embodiments of portable heating unit provided by the present invention, it should be apparent to those skilled in the art that various changes may be made in the form of the invention without affecting the scope thereof.

What we claim is:

1. A portable heater which comprises a housing, a heating chamber disposed within said housing, a heat source disposed within said heating chamber, said heat source having a heat-radiating surface, said heating chamber having a wall which extends around and which receives heat from confronting portions of said heat-radiating surface of said heat source, said heating chamber having a front through which heat from said source can readily pass, and a guard which overlies substantially all of said front of said heating chamber and which also overlies a portion of the top of said housing, whereby said guard limits the likelihood of accidental contact of persons or objects with said front of said heating chamber or with said portion of said top of said housing.

2. A portable heater as claimed in claim 1 wherein said housing has an air outlet adjacent said portion of said top thereof, and wherein said guard overlies said air outlet.

3. A portable heater as claimed in claim 1 wherein hinge means secure one end of said guard to said housing while permitting the other end of said guard to move toward and away from said housing, and wherein quick-release, resilient holding means releasably hold said other end of said guard adjacent said housing.

4. A portable heater as claimed in claim 1 wherein said housing has an air outlet adjacent said portion of said top thereof, wherein said guard overlies said air outlet, wherein hinge means secure one end of said guard to an upper part of said housing while permitting the other end of said guard to move toward and away from a lower part of said housing, and wherein holding means releasably hold said other end of said guard adjacent said housing.

5. A portable heater as claimed in claim 1 wherein said housing has an air outlet adjacent said portion of said top thereof, wherein said guard overlies said air outlet, wherein hinge means secure one end of said guard to an upper part of said housing while permitting the other end of said guard to move toward and away from a lower part of said housing, and wherein quick-release, resilient holding means releasably hold said other end of said guard adjacent said lower part of said housing, whereby said guard will tend to remain in position to limit the likelihood of accidental contact of persons or objects with said front of said heating chamber even if said other end of said guard is not held by said quick-release, resilient holding means.

6. A portable heater as claimed in claim 3 wherein the top of said housing is substantially imperforate to substantially keep heated air within said air space from passing through said top of said housing.

* * * * *